US011781541B2

(12) United States Patent
Kuo et al.

(10) Patent No.: US 11,781,541 B2
(45) **Date of Patent: *Oct. 10, 2023**

(54) OIL-SCAVENGE PUMP AND METHOD FOR ASSEMBLING THE SAME

(71) Applicant: CHIPMAST AUTOTRONIX CO., LTD., Hshinchu Country (TW)

(72) Inventors: Hung-Ta Kuo, Hshinchu Country (TW); Chi-Ju Lee, Hshinchu Country (TW)

(73) Assignee: CHIPMAST AUTOTRONIX CO., LTD., Hshinchu Country (TW)

( * ) Notice: Subject to any disclaimer, the term of this patent is extended or adjusted under 35 U.S.C. 154(b) by 45 days.

This patent is subject to a terminal disclaimer.

(21) Appl. No.: 17/489,582

(22) Filed: Sep. 29, 2021

(65) Prior Publication Data

US 2023/0104415 A1 Apr. 6, 2023

(51) Int. Cl.
*F04B 43/00* (2006.01)
*F04B 43/067* (2006.01)

(52) U.S. Cl.
CPC ..... *F04B 43/0009* (2013.01); *F04B 43/067* (2013.01)

(58) Field of Classification Search
CPC ..... F04B 43/0009; F04B 43/067; B23P 6/02; B23P 15/00; F04B 39/14; F04C 2230/604; F04C 2230/60; F04C 2230/00; B22F 5/02; B23B 2215/247; B23P 15/06; B23P 15/08; F16J 9/00
USPC ..... 417/313
See application file for complete search history.

(56) References Cited

U.S. PATENT DOCUMENTS 5,232,273 A * 8/1993 Eckstein et al. ..... B60T 8/4068 303/116.4
5,395,219 A * 3/1995 Hosoya et al. ..... F04B 53/1002 417/454
5,567,128 A * 10/1996 Volz et al. ..... B60T 8/4031 417/313
6,000,764 A * 12/1999 Dokas ..... F04B 53/22 137/15.08
6,082,244 A * 7/2000 Siegel et al. ..... B60T 8/4031 417/313

(Continued)

*Primary Examiner* — Kenneth J Hansen
*Assistant Examiner* — Benjamin Doyle
(74) *Attorney, Agent, or Firm* — HDLS IPR SERVICES; Chun-Ming Shih

(57) ABSTRACT

The present disclosure provides an oil-scavenge pump, which includes a cap member, a piston member, a resilient member and a filter member. The filter member interconnects the cap member and the piston member. The resilient member is disposed between the cap member and the piston member. The cap member includes a cap head, a pump valve connected to the cap head, a first-resilient unit disposed and a first sphere disposed between the first-resilient unit and the pump valve. The piston member includes a main portion, a piston seat, a second-resilient unit, a second sphere and a rod portion. The piston seat has two ends respectively connected to the piston head and the rod portion. The second-resilient unit and the second sphere are disposed between the piston head and the piston seat. The filter member is mounted to surround the rod portion and engaged with the pump valve.

9 Claims, 5 Drawing Sheets

(56) References Cited

U.S. PATENT DOCUMENTS 6,113,365 A * 9/2000 Siegel ..... B60T 8/4031 417/434
6,126,418 A * 10/2000 Sinnl ..... F04B 53/126 417/470
6,217,300 B1* 4/2001 Schuller et al. ..... B60T 8/4031 417/454
6,224,352 B1* 5/2001 Hauser et al. ..... F04B 53/20 417/313
6,283,733 B1* 9/2001 Merklein et al. ..... F04B 1/0421 92/78
6,302,663 B1* 10/2001 Schuller et al. ..... F04B 1/0408 417/470
6,334,762 B1* 1/2002 Hauser et al. ..... F04B 53/168 417/470
6,340,295 B1* 1/2002 Hauser et al. ..... B60T 8/4031 417/470
6,413,238 B1* 7/2002 Maget ..... A61M 5/14526 604/67
6,457,956 B1* 10/2002 Hauser et al. ..... F04B 53/126 417/470
6,520,756 B1* 2/2003 Alaze ..... B60T 8/4068 417/540
7,237,474 B2* 7/2007 Schlitzkus et al. . F04B 11/0091 92/78
7,390,174 B2* 6/2008 Dinkel et al. ..... B60T 8/4031 417/570
7,690,899 B2* 4/2010 Harada ..... F04B 1/0408 417/523
7,704,058 B2* 4/2010 Harada et al. ..... F04B 53/143 417/549
8,241,020 B2* 8/2012 Zimmermann ..... F04B 1/0452 417/548
8,353,691 B2* 1/2013 Sonnenschein et al. ..... F04B 53/126 417/470
8,388,326 B2* 3/2013 Sumimoto et al. ... F04B 1/0408 417/470
8,523,541 B2* 9/2013 Hermann ..... B60T 8/4031 137/15.19
8,845,038 B2* 9/2014 Hipp et al. ..... F04B 53/10 92/255
9,174,620 B2* 11/2015 Starr ..... B60T 17/02
10,730,496 B2* 8/2020 Schumann et al. ... F04B 53/001
11,111,914 B2* 9/2021 Choi ..... B60T 17/02
2001/0016171 A1* 8/2001 Schuller et al. ..... F04B 53/168 417/545
2001/0048884 A1* 12/2001 Siegel et al. ..... F04B 53/126 417/470
2002/0034451 A1* 3/2002 Abe et al. ..... F04C 29/045 417/313
2002/0155008 A1* 10/2002 Hauser et al. ..... F04B 53/20 417/313
2005/0063846 A1* 3/2005 Maeda ..... B60T 8/4031 417/471
2005/0074348 A1* 4/2005 Maeda et al. ..... B60T 8/4031 417/470
2006/0013702 A1* 1/2006 Dinkel et al. ..... F04B 1/0408 417/559
2006/0177326 A1* 8/2006 Harada et al. ..... F04B 1/0452 417/470
2007/0092389 A1* 4/2007 Dinkel et al. ..... F04B 53/168 417/554
2007/0114837 A1* 5/2007 Kusano ..... B60T 7/042 417/259
2008/0226479 A1* 9/2008 Schuller et al. ..... F04B 53/14 417/545
2009/0045380 A1* 2/2009 Aiken ..... B66F 3/247 254/131
2013/0177455 A1* 7/2013 Kamen et al. ..... F04B 43/12 417/313
2014/0023544 A1* 1/2014 Lucas ..... F04C 14/06 418/69
2014/0363324 A1* 12/2014 Braun ..... F04B 49/22 417/559
2016/0129536 A1* 5/2016 Huckenbeck et al. ..... F04B 53/1087 29/888.044
2017/0138490 A1* 5/2017 Haeusser et al. ..... B60T 8/341
2017/0291586 A1* 10/2017 Norberg et al. ..... F04B 11/00

* cited by examiner

OIL-SCAVENGE PUMP AND METHOD FOR ASSEMBLING THE SAME

TECHNICAL FIELD

The present disclosure relates to an oil-scavenge pump and a method for assembling the oil-scavenge pump, which can be easy to assemble and be further mounted into a hydraulic device.

BACKGROUND

For safe driving, many modem vehicles are disposed with anti-lock braking systems (ABS), which are adapted to adjust braking function of wheels, such that to adjust traction force and prevent the wheels from locking up then slipping out of control, during emergency braking or driving on a road with inappropriate condition.

A common ABS can adjust the traction force by utilizing combination of software (programming), hardware (controller) and transmission mechanisms, such that to help gaining controllability of the vehicle against any accident. The modem ABS mainly employ hydraulic equipment as the transmission mechanism, which is assembled from multiple components connected to each other by welding, such that to achieve high fluid tightness.

The welding process can easily bind, connect surfaces in different or complicated shapes together, however the connection by welding is vulnerable to vibration and high temperature. A hydraulic equipment with motors and pumps that generates vibrations and heat, which may lose its fluid-tight condition after some usage, especially when the emergency brake is applied, the hydraulic equipment works at an instantly fast rate, which also generates enormous vibrations and heat in short burst and may destruct and break up the connection between welded components, and thereby to cause failure of the ABS.

Oil-scavenge pump is an oil-flow-control unit within a hydraulic device, which is required to work and stop in an instant, intermittent manner, thus a large amount of machine stress and vibration can occur in a short burst, and therefore which is also required to be secured, tightly fastened within the hydraulic device. A conventional oil-scavenge pump has a complicated structure, which may hence cause a difficulty of assembling, and moreover, by an improper, inaccurate assembling process, it can be also difficult to mount and secure the oil-scavenge pump within the hydraulic device well. In addition, a welding process may be applied to help fastening the oil-scavenge pump within the hydraulic device, however, a quality of the welding may also be difficult to control, and therefore to cause an unstable quality of product.

SUMMARY

Therefore, to overcome the abovementioned drawbacks of the conventional technology, the present disclosure provides an oil-scavenge pump, which includes four components as a cap member, a piston member and a resilient member, wherein those four components can be pre-assembled. With such improved structure and pre-assembled configuration, an assembling process of the oil-scavenge pump can be simplified and hence can be proceeded efficiently. Moreover, the oil-scavenge pump can be fastened and sealed well within the hydraulic device by riveting, such that, there is no need of the welding process with unstable quality for mounting the oil-scavenge pump into the hydraulic device. Therefore, the driving safety can be improved by virtue of the oil-scavenge pump.

According to at least one of the abovementioned object, the present disclosure provides an oil-scavenge pump, which includes a cap member, a piston member, a resilient member and a filter member. The cap member and the piston member are connected to each other, via the filter member. The resilient member is disposed between the cap member and the piston member. The cap member includes a cap head, a pump valve, a first-resilient unit and a first sphere. The pump valve is connected to the cap head, the first-resilient unit disposed between the cap head and the pump valve, the first sphere is disposed between the first-resilient unit and the pump valve. The piston member includes a piston head, a piston seat, a second-resilient unit, a second sphere and a rod portion. The piston seat interconnects the piston head and the rod portion, the second-resilient unit is disposed between the piston head and the piston seat, the second sphere is disposed between the second-resilient unit and the piston seat. The filter member is mounted to surround the rod portion and connected to the pump valve of the cap member.

Optionally, the oil-scavenge pump further comprises a seal ring, a pad and a jacket ring that are all mounted to surround the rod portion. The seal ring is disposed between the filter member and the pad, the pad is positioned between the seal ring and the jacket ring.

Optionally, the resilient member, the first-resilient unit and the second-resilient unit are springs, the first sphere and the second sphere are steel balls, the filter member is a filter net, the seal ring is an X-ring, also, the jacket ring is made of brass.

Optionally, the piston head has an outer diameter corresponding to an inner diameter of the pump valve, such that the piston head is slidable related to the pump valve.

Optionally, the piston seat has a first end and a second end respectively connected to the piston head and the rod portion. The first end has an outer diameter smaller than that of the piston head. The second end has an inner diameter corresponding to an diameter of the rod portion, such that an inner wall of the second end contacts and fits an outer wall of the rod portion.

Optionally, the oil-scavenge pump further includes an oil inlet disposed on the piston seat and an oil outlet disposed on the pump valve.

Moreover, the present disclosure also provides a method for assembling an oil-scavenge pump, which includes: a step of hierarchically pre-assembling three components, as a cap member, a piston member, a resilient member and filter member; a next step of assembling the piston member, the resilient member, the cap member and the filter member into the oil-scavenge pump; an another step of pressing a jacket ring into a mounting slot of a hydraulic device, then placing the a pad and a seal ring into the mounting slot sequentially; and a final step of pressing and mounting the fully-assembled oil-scavenge pump into the mounting slot of the hydraulic device.

By virtue of the method for hierarchically assembling the oil-scavenge pump, which allows each of the components of the oil-scavenge pump to be properly mounted in accordance with their functions, such that to simplify the process of assembling the oil-scavenge pump and also the process of mounting the oil-scavenge pump into the hydraulic device. In addition, by virtue of the riveting process, which also enhances a structural strength of the assembled oil-scavenge pump, and a connection between the oil-scavenge pump and the hydraulic device.

According to at least one of the abovementioned object, the present disclosure provides a method for assembling the oil-scavenge pump, wherein the oil-scavenge pump is adapted to a mounting slot of a hydraulic device. The method includes: a step of pressing and mounting the jacket ring into the mounting slot; a step of placing the pad and the seal ring into the mounting slot; a step of assembling the cap member, the resilient member and the piston member together, and mounting the filter member to connect the cap member and the piston member, such that to retain the resilient member between the cap member and the piston member; and a step of pressing and mounting the assembled the cap member, the resilient member and the piston member into the mounting slot, and having the rod portion of the piston member to pass through the seal ring, the pad and the jacket ring, such that to assemble into the oil-scavenge pump and mount the oil-scavenge pump into the hydraulic device.

Optionally, the abovementioned method further includes a step of fastening the oil-scavenge pump within the mounting slot of the hydraulic device by a riveting process.

Optionally, the step of assembling the oil-scavenge pump within the mounting slot, which further includes a process of mounting the pad and the seal ring within the mounting slot in a manner of interference fit.

To be brief, the present disclosure provides an oil-scavenge pump and a method for assembling the same, wherein the oil-scavenge pump can have pre-assembled four components (the cap member, the piston member, the resilient member and filter member) for example, such that to simplify, facilitate the assembling process and also to omit the welding process with unstable quality. Moreover, by virtue of a riveting process to fasten the oil-scavenge pump, which can improve a fluid tightness and durability of the hydraulic device, and hence to ensure the driving safety, therefore the hydraulic device has advantages for different needs in market (e.g. car makers, motorcycle makers, ABS makers, etc.).

BRIEF DESCRIPTION OF THE DRAWINGS

The structure as well as preferred modes of use, further objects, and advantages of this present disclosure will be best understood by referring to the following detailed description of some illustrative embodiment(s) in conjunction with the accompanying drawings, in which.

DETAILED DESCRIPTION OF THE PREFERRED EMBODIMENTS

To fully understand the objects, features and functions of the present disclosure, herein to explain details thereof by the following embodiment(s), with the attached drawings.

The present disclosure provides an oil-scavenge pump, which includes four components as a cap member, a piston member, a resilient member and a filter member, wherein those components can be pre-assembled individually for easily assembling into the oil-scavenge pump. The oil-scavenge pump is adapted to a hydraulic device, which includes a main body formed with a plurality of mounting slots spatially connected to each other, wherein the mounting slots are for mounting the oil-scavenge pump and other components (e.g. motor, pressure-increasing valve or pressure-reducing valve, etc.). The oil-scavenge pump is mounted into one of the mounting slots on the main body, in a manner of interference fit or press fit. Also, each of those components of the oil-scavenge pump has a structure corresponding to that of the mounting slot, further with a seal ring and a jacket ring tightly contacting and fitting an inner wall of the mounting slot, the oil-scavenge pump can be secured and stably connected to the main body. Also, by virtue of such structure and configuration, an assembling process of the oil-scavenge pump can be simplified, therefore the present disclosure further provides a method for assembling the oil-scavenge pump.

Figure 1:
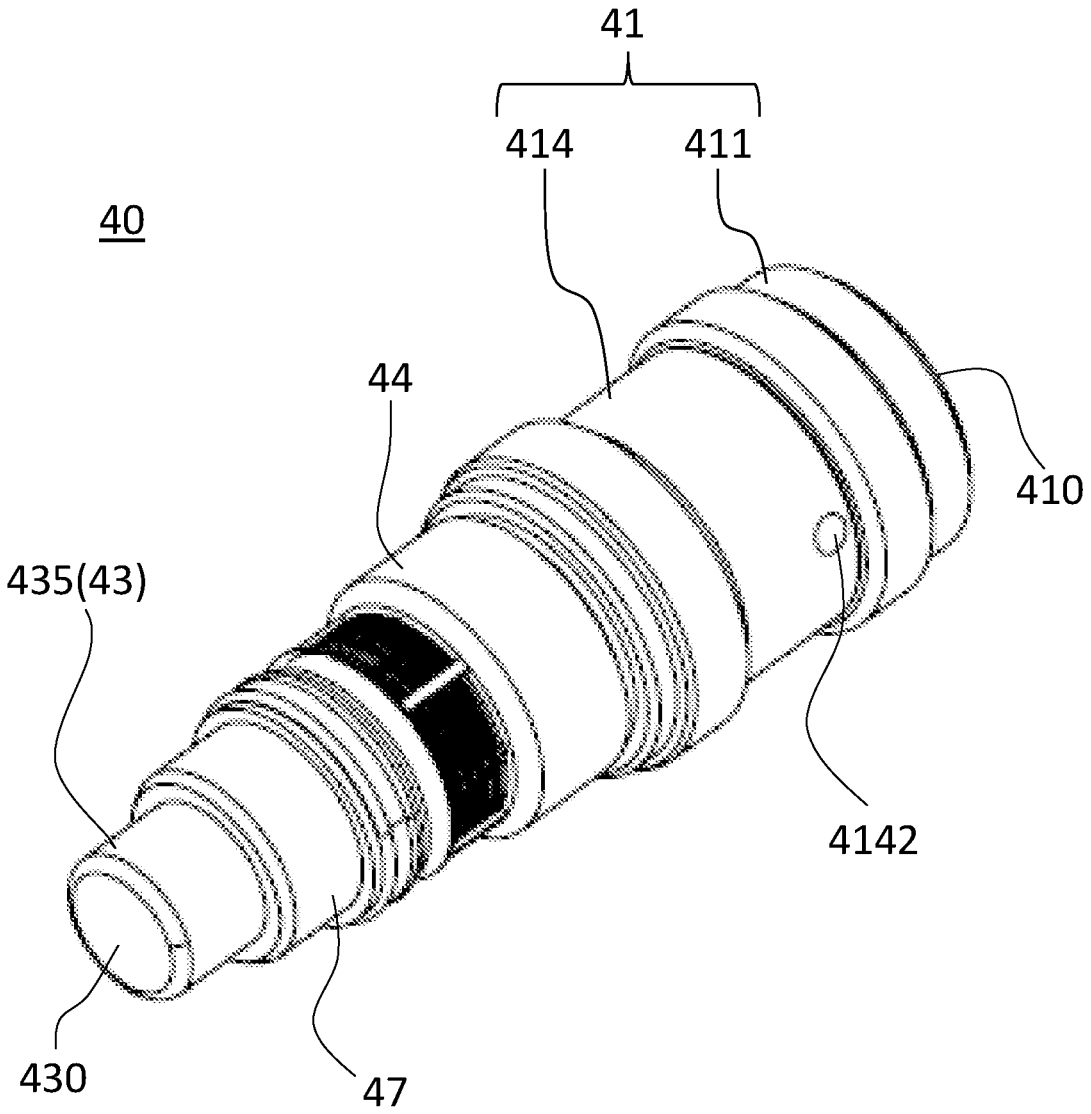
FIG. 1 is a perspective view of an oil-scavenge pump according to one embodiment of the present disclosure.
Figure 2:
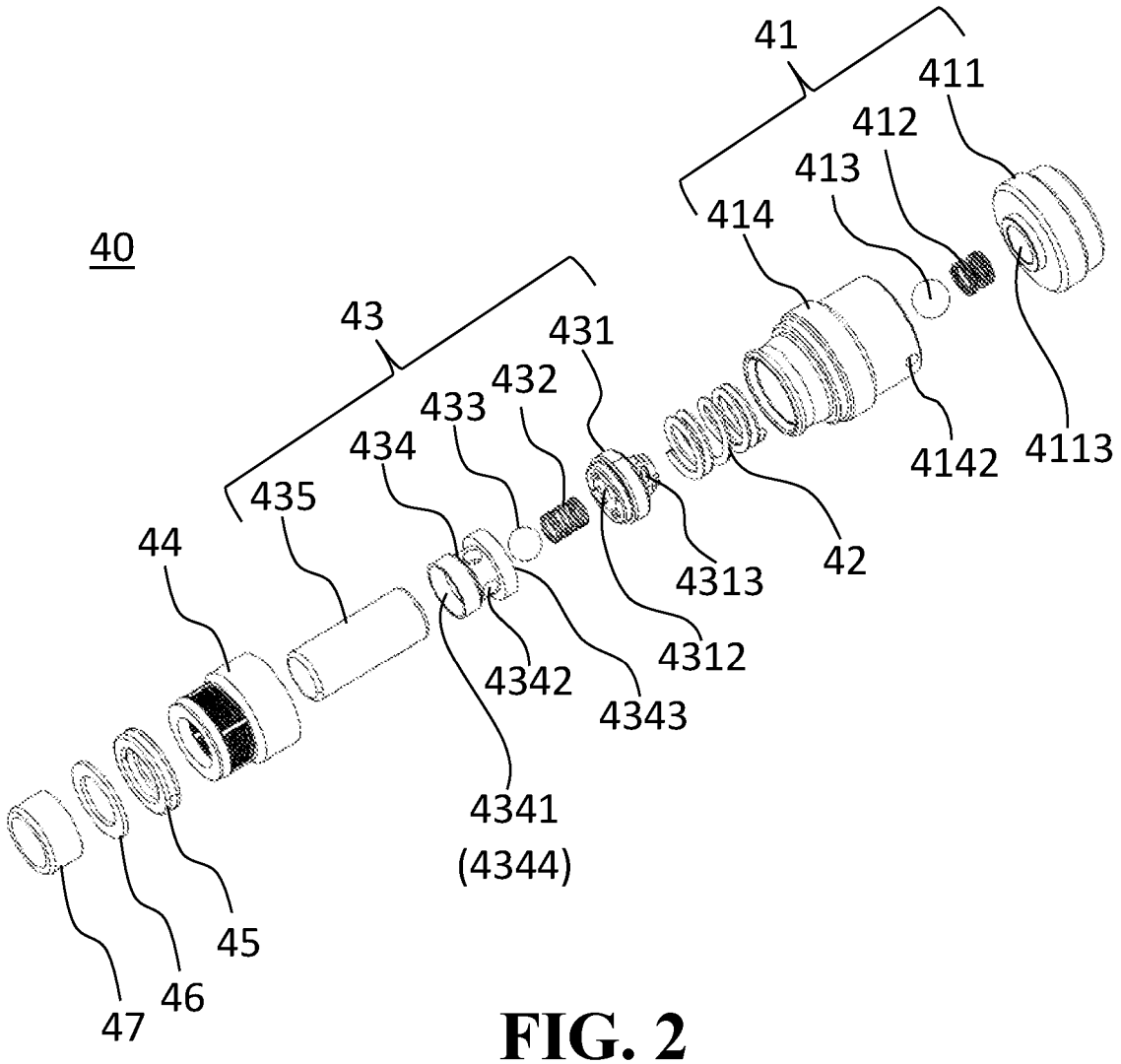
FIG. 2 is a perspective exploded view of the oil-scavenge pump according to one embodiment of the present disclosure.
Figure 3:
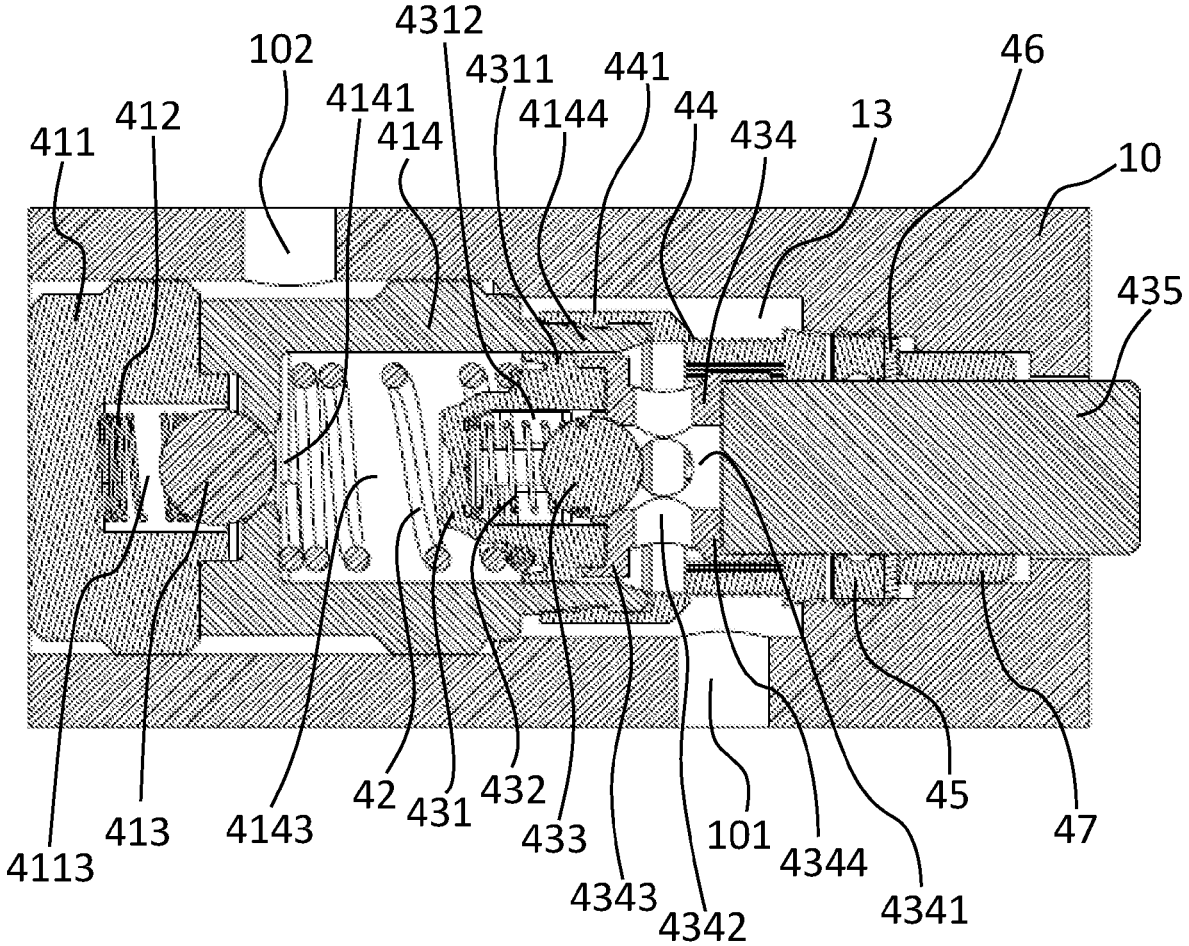
FIG. 3 is a fragmentary sectional view illustrating the oil-scavenge pump mounted into a main body of a hydraulic device, according to one embodiment of the present disclosure.

First referring to FIG. 1 ~ FIG. 3, which are respectively a perspective view and an exploded view of an oil-scavenge pump 40, and a sectional view of the oil-scavenge pump 40 mounted into a main body 10 of a hydraulic device. The oil-scavenge pump 40 has a proximately cylindrical appearance, and also has a head end 410 and a rod end 430. In more detail, the oil-scavenge pump 40 mainly includes four components, as a cap member 41, a resilient member 42, a piston member 43 and a filter member 44. The cap member 41 is positioned at the head end 410, in the other hand, the piston member 43 is positioned at the rod end 430. The filter member 44 interconnects the cap member 41 and the piston member 43, the resilient member 42 is positioned between the cap member 41 and the piston member 43.

As shown in FIG. 2 and FIG. 3, the cap member 41 includes a cap head 411, a first-resilient unit 412, a first sphere 413 and a pump valve 414. The cap head 411 is disposed at the head end 410 of the oil-scavenge pump 40. The first-resilient unit 412 and the first sphere 413 are disposed between the cap head 411 and the pump valve 414 is connected to the cap head 411.

Specifically, the cap head 411 is formed with a proximately cylindrical appearance, and has one end fluidly sealed off (left side in FIG. 3), and another end formed with a cap cavity 4113 (right side in FIG. 3). The first-resilient unit 412 and the first sphere 413 are disposed within the cap cavity 4113 of the cap head 411. The pump valve 414 is connected to the cap head 411, such that to retain the first-resilient unit 412 and the first sphere 413 therebetween and within the cap cavity 4113.

The first-resilient unit 412 has one end contacting and abutting the cap head 411, and another end contacting and abutting the first sphere 413. The first sphere 413 is neutrally pushed by the first-resilient unit 412 to shut and block a pump-valve hole 4141 (in detail later) of the pump valve 414 in a normal state. However, with a sufficient fluid pressure toward the cap head 411 from the pump-valve hole 4141 (leftward in FIG. 3), the first sphere 413 can move toward the cap head 411 against the first-resilient unit 412, hence to leave the pump-valve hole 4141 in an open state.

In the other hand, the pump valve 414 is formed with a proximately cylindrical appearance, and has one end formed with the pump-valve hole 4141, and another end formed with a valve cavity 4143 spatially connected to the pump-valve hole 4141. Also to mention that, the valve cavity 4143 is for containing the resilient member 42 and a portion of the piston member 43. Overall, the pump valve 414 is connected to the cap member 41 with the pump-valve hole 4141 facing the cap cavity 4113, also to retain the first-resilient unit 412 and the first sphere 413 therebetween and within the cap cavity 4113, such that to assemble into the cap member 41. Moreover, the another end of the pump valve 414 is disposed with an annular first-anchor structure, for engaging with an annular second-anchor structure (in detail later) 441 of the filter member 44.

As shown in FIG. 3, the resilient member 42 is positioned within the valve cavity 4143 of the pump valve 414. The resilient member 42 has one end abutting an inner wall of the valve cavity 4143 of the pump valve 414, and another end abutting and pushing a piston head 431 (in detail later) of the piston member 43 toward the filter member 44.

As shown in FIG. 2, the piston member 43 includes the aforementioned piston head 431, a second-resilient unit 432, a second sphere 433, a piston seat 434 and a rod portion 435. As shown in FIG. 3, the rod portion 435 is positioned at the rod end 430 (FIG. 1) of the oil-scavenge pump 40, the piston seat 434 interconnects the piston head 431 and the rod portion 435, the second-resilient unit 432 and the second sphere 433 are covered by and disposed between the piston head 431 and the piston seat 434.

Specifically, the piston head 431 is formed with a proximately cap-like appearance, and movably engaged with the pump valve 414 of the cap member 41. The piston head 431 has one end contacting the resilient member 42 and another end formed with a piston cavity 4312 for containing the second-resilient unit 432 and the second sphere 433. Furthermore, the one end of the piston head 431 has a lateral side formed with a piston hole 4313 (FIG. 2) that is spatially connected to the piston cavity 4312. Also, the another end of the piston head 431 is engaged with the piston seat 434.

Moreover, in this embodiment, as shown in FIG. 3, the piston head 431 has a middle portion between the one end and the another end, wherein the middle portion is formed with a slide flange 4311 which has an outmost outer diameter on the piston head 43 corresponding to and substantially equal to an inner diameter of the pump valve 414 (i.e. diameter of the valve cavity 4143). More specific, the slide flange 4311 is formed with a structure that protrudes radially-outward from the middle portion of the piston head 431, and then bends toward the cap member 41 and substantially parallel to a surface of the middle portion, such that to create a gap between the slide flange 4311 and the middle portion. The piston head 43 slidably engages with and contacts the inner wall of the pump valve 414, via the slide flange 4311 with the outmost diameter only, such that to minimize a friction between the piston head 43 and the pump valve 414 during the sliding movement, but yet able to maintain a fluid tightness therebetween. However, it should be noted that the present disclosure is not limited to such structure of the piston head 43, the slide flange 4311 is merely an additional, optional configuration, the piston head 43 may directly contact the inner wall of the pump valve 414 with the middle portion thereof, in other embodiment.

As shown in FIG. 3, the second-resilient unit 432 is contained within the piston cavity 4312 of the piston head 431, and has one end abutting an inner wall of the piston cavity 4312, and another end abutting the second sphere 433. The second-resilient unit 432 neutrally abuts, pushes the second sphere 433 to plug and block a piston-seat hole 4341 (in detail later) of the piston seat 434 in a normal state, however, with a sufficient fluid pressure toward the piston head 431 from the piston-seat hole 4341 (leftward in FIG. 3), the second sphere 433 can move against the second-resilient unit 432 in an open state and hence to leave the piston-seat hole 4341.

As shown in FIG. 2 and FIG. 3, the piston seat 434 is formed with a proximately tubular appearance. The piston seat 434 has a first end 4343 engaged with the piston head 431 from side of the piston cavity 4312, to position and retain the second-resilient unit 432 and the second sphere 433 therebetween. The piston seat 434 also has a second end 4344 engaged with the rod portion 435. Furthermore, the piston seat 434 is formed with the piston-seat hole 4341, which extends through the one end and the another end of the piston seat 434.

As shown in FIG. 3, the piston seat 434 is partially contained within the pump valve 414, wherein the piston seat 434 has an outer diameter smaller than the outmost outer diameter of the piston head 431. Therefore, the piston member 43 contacts the inner wall of the pump valve 414 only by the piston head 431, the piston seat 434 does not contact the pump valve 414, such that to minimize the friction created when the piston member 43 slides related to the pump valve 414.

In this embodiment, the piston-seat hole 4341 is respectively formed with two countersinks at the one end and the another end of the piston seat 434, for respectively engaging with and positioning the another end of the piston head 431 and an end of the rod portion 435 within the piston-seat hole 4341. The another end of the piston head 431 is formed with an outer diameter equal to or slightly larger (preferable) than an inner diameter of the first end 4343 (i.e. diameter of the countersink), for a tight engagement therebetween in a manner of just fit or interference fit (preferable). In the other hand, the rod portion 435 is formed proximately cylindrical and has an diameter corresponding to, equal to or slightly larger (preferable) than an inner diameter of the second end 4343 (i.e. diameter of the another countersink), for a tight engagement therebetween in a manner of just fit or interference fit (preferable). Thereby, an outer wall of the another end of the piston head 431 tightly contacts and fits an inner wall of the first end 4343 of the piston seat 434, in the other hand, an outer wall of the rod portion 435 tightly contacts and fits an inner wall of the second end 4344 of the piston seat 434, such that to assemble into the piston member 43. However, the present disclosure is not limited to such engagement manner of having the piston seat 434 inserted by the piston head 431 and the rod portion 435, in other embodiment, is may be configured to have the first end of the piston seat inserted into the piston head, or the second end inserted into the rod portion.

The filter member 44 is formed with a proximately tubular appearance, which is mounted to surround the rod portion 435 of the piston member 43 and engaged with the pump valve 414 of the cap member 41, and which is for filtrating impurities in hydraulic fluid. The filter member 44 has one end formed with the aforementioned second-anchor structure 441, for engaging with the first-anchor structure 4144 of the pump valve 414. The filter member 44 also has another end formed with an inner diameter substantially equal to or slightly smaller than a diameter of the rod portion 435, such that the filter member 44 is fastened on and surrounds the rod portion 435. In this embodiment, the one end and the another end of the filter member 44 are formed with different inner diameters, corresponding to the outer diameter of the cap member 41 and the diameter of the rod portion 43. The filter member 44 partially contains the piston member 43 (the piston head 431, the second-resilient unit 432, the second sphere 433, the piston seat 434 and a portion the rod portion 435), and also surrounds and engages with the first-anchor structure 4144 by the second-anchor structure 441. However, the present disclosure is not limited to such structure of the filter member 44, in other embodiment, the filter member 44 may be configured to further have a third-anchor structure for engaging with the rod portion 435.

With the piston head 431 and the first end 4343 of the piston seat 434 are contained within the valve cavity 4143 of the pump valve 414, also with the resilient member 42 positioned and retained between the piston member 43 and the cap member 41, and furthermore with the filter member 44 to partially contain the piston member 43 and engage with the cap member 41, such that to assemble into the oil-scavenge pump 40.

As shown in FIG. 2 and FIG. 3, in one embodiment, the oil-scavenge pump 40 may further include a seal ring 45, a pad 46 and a jacket ring 47 those are disposed to surround the rod portion 435 of the piston member 43, wherein the seal ring 45 is positioned between the filter member 44 and the pad 46, the pad 46 is positioned between the seal ring 45 and the jacket ring 47. In this embodiment, each of the seal ring 45, the pad 46 and the jacket ring 47 has an inner diameter substantially equal to the diameter of the rod portion 435, moreover, the seal ring 45 and the pad 46 has an outer diameter larger than that of the jacket ring 47, however, the present disclosure is not limited thereto. Furthermore, the oil-scavenge pump 40 further include an oil inlet 4342 disposed on the piston seat 434 and an oil outlet 4142 disposed on the pump valve 414 adjacent to the pump-valve hole 4141, for a hydraulic fluid (e.g. oil) to flow in and out.

In one embodiment, the first-resilient unit 412, the second-resilient unit 432 and the resilient member 42 are restoring springs, the first sphere 413 and the second sphere 433 are steel balls, the filter member 44 is a filter net, the seal ring 45 is an X-ring, the jacket ring 47 is made of brass, however, the present disclosure is not limited thereto.

Figure 5:
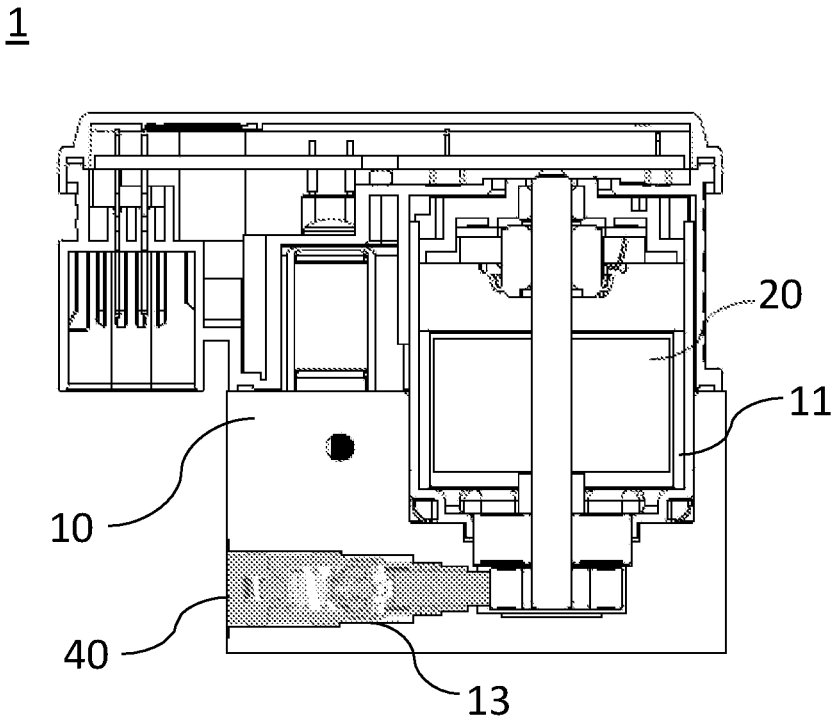
FIG. 5 is a sectional view of the oil-scavenge pump mounted into the hydraulic device, according to one embodiment of the present disclosure.

Referring to FIG. 5, which is a sectional view of the oil-scavenge pump 40 mounted into the hydraulic device 1, according to one embodiment of the present disclosure. The oil-scavenge pump 40 is adapted to be mounted within a hydraulic device 1, which includes a main body 10, a drive unit 20 and the abovementioned oil-scavenge pump 40. The main body 10 is formed a plurality of mounting slots 11, 13 spatially connected to each other, and for respectively mounting the drive unit 20 and the oil-scavenge pump 40. Furthermore, as shown in FIG. 3, the main body 10 is also formed with an oil entrance 101 and an oil exit 102 adjacent to and fluidly connected to the mounting slots 13.

During a process of mounting the oil-scavenge pump 40 into the mounting slot 13 on the main body 10 of the hydraulic device 1, the jacket ring 47, the pad 46 and the seal ring 45 are placed into the mounting slot 13 of the main body 10 in advance. Meanwhile, the cap member 41, the resilient member 42, the piston member 43 and the filter member 44 are pre-assembled individually then combined together, and then be mounted into the mounting slot 13 to combine with the jacket ring 47, the pad 46 and the seal ring 45, such that to fully assemble into the oil-scavenge pump 40 within the mounting slot 13. Thereafter, the oil-scavenge pump 40 is further fastened and sealed off within the mounting slot 13 of the main body 10, for stabilizing.

As shown in FIG. 3, to be specific, the jacket ring 47 is pressed into the mounting slot 13, the pad 46 and the seal ring 45 are placed into the mounting slot 13 sequentially. Thereafter, the cap member 41 and the piston member 43 are first pre-assembled individually and then combined with the resilient member 42 and the filter member 44. On next, the assembled cap member 41 and the resilient member 42 and the piston member 43 and the filter member 44 are pressed into the mounting slot 13, and then, the rod portion 435 of the piston member 43 squeezes and passes through the jacket ring 47, the pad 46 and the seal ring 45, such that to construct and assemble into the oil-scavenge pump 40. Also, the piston member 43 squeezes and passes through the seal ring 45, such that to stretch the seal ring 43 wider to tightly contact and fit an inner wall of the mounting slot 13, and to achieve fluid tightness. Furthermore, the rod portion 435 also passes through the mounting slot 13 into the another mounting slot 11, such that to power-transmittably connect to the drive unit 20. Moreover, the assembled oil-scavenge pump 40 is fastened within the main body 10, by a riveting process.

As shown in FIG. 3 and FIG. 5, when the oil-scavenge pump 40 is mounted into the mounting slot 13 of the main body 10, the hydraulic device 1 can have a hydraulic fluid (e.g. oil but not limited thereto) entering from the oil entrance 101, then the hydraulic fluid passes through the filter member 44 of the oil-scavenge pump 40 and flows into the oil inlet 4342 on the piston seat 434 of the piston member 43, then be stored within the piston-seat hole 4341. As the drive unit 20 drives the rod portion 435 and the entire piston member 43 to move toward the cap head 411 of the cap member 41 (leftward in FIG. 3), and such that to press the hydraulic fluid within the valve cavity 4143 out of the pump-valve hole 4141, and thus the hydraulic fluid with pressure pushes out the first sphere 413 and then flow out of the oil-scavenge pump 40 from the oil outlet 4142 (FIG. 2) on the pump valve 414, thereafter the hydraulic fluid with pressure flows into the oil exit 102 as an output flow. Thereafter, the drive unit 20 may reversely drive the rod portion 435 and the entire piston member 43 to leave the cap head 411 (rightward in FIG. 3), such that a negative pressure is created within the valve cavity 4143 to pull the second sphere 433 away from the piston-seat hole 4341 by suction, and as so to extract the stored hydraulic fluid therein to the valve cavity 4143.

In one embodiment, the hydraulic device 1 is an anti-lock brake system (ABS), the main body 10 is a platform, the drive unit 20 is a motor which is power-transmittably connected to the oil-scavenge pump 40 via the spatially connected the mounting slots 11, 13. In addition, the drive unit 20 may be disposed with a bearing, rotary shaft, gear or cam, in order to facilitate driving the oil-scavenge pump 40. However, the present disclosure is not limited to such structural relationship, the drive unit can also be disposed to indirectly connect and drive the oil-scavenge pump, in other embodiment.

By virtue of such structure and configuration of the oil-scavenge pump 40, which reduces number of component, also with the basic four components 41, 42, 43, 44 that can pre-assembled individually in advance, such that an assembling process of the oil-scavenge pump 40 can be simplified and proceeded swiftly.

Figure 4:
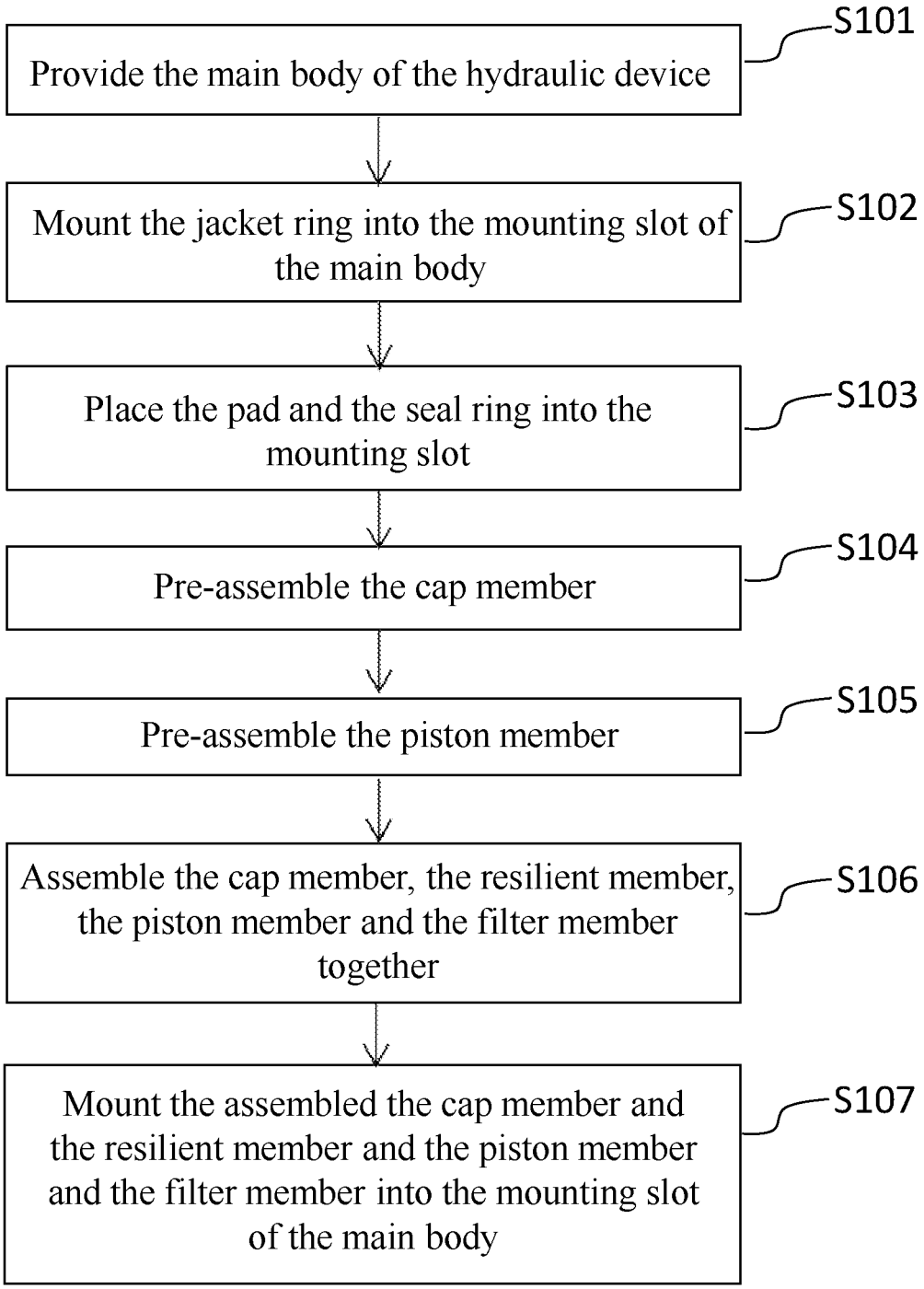
FIG. 4 is a flowchart of a method for assembling the oil-scavenge pump, according to one embodiment of the present disclosure.

Referring to FIG. 4, which is a flowchart of a method for assembling the oil-scavenge pump 40, according to one embodiment of the present disclosure. Herein to describe the following steps S101 ~ S107 of assembling the oil-scavenge pump 40, wherein the oil-scavenge pump 40 is adapted to be mounted into the main body 10 of the hydraulic device 1. The step S101 is to provide the main body 10 of the hydraulic device 1, wherein the main body 10 is disposed with the mounting slot 13, the oil entrance 101 and the oil exit 102. Furthermore, the mounting slot 13 are formed with a plurality of countersinks (right side in FIG. 3) with different diameters, wherein those countersinks are formed with larger diameters on an external side of the main body 10 and smaller diameters on an internal side of the main body 10, and the diameters of the countersinks are formed narrower and narrower from the external side to the internal side sequentially, On next, the step S102 is to press and mount the jacket ring 47 into the mounting slot 13 of the main body 10, wherein the jacket ring 47 is concentrically disposed into the mounting slot 13 on the innermost countersink with the smallest diameter, in a manner of interference fit. Such that, an outer wall of the jacket ring 47 tightly contacts and fits the inner wall of the mounting slot 13, and hence the jacket ring 47 is fastened within the mounting slot 13.

On next, the step S103 is to place the pad 46 and the seal ring 45 into the mounting slot 13 sequentially, such that the pad 46 is positioned between the seal ring 45 and the jacket ring 47. Also to mention that, the seal ring 45, the pad 46 and the jacket ring 47 are disposed in a substantially concentric manner, within the mounting slot 13.

On next, the step S104 is to pre-assemble the cap member 41, which starts from placing the first-resilient unit 412 and the first sphere 413 sequentially into the cap cavity 4113 of the cap head 411. The next is to engage the one end (with the pump-valve hole 4141) of the pump valve 414 with the another end (with the cap cavity 4113) of the cap head 411, in a manner of interference fit, such that to completely assemble the cap member 41.

On next, the step S105 is to pre-assemble the piston member 43, which starts from placing the second-resilient unit 432 and the second sphere 433 into the piston head 431 of the piston head 431 sequentially, thereafter to engage the another end (with the piston cavity 4312) of the piston head 431 with the first end 4343 of the piston seat 434, in a manner of interference fit, also to retain the second-resilient unit 432 and the second sphere 433 within the piston cavity 4312. Also, at last to engage the rod portion 435 with the second end 4344 of the piston seat 434 in a manner of interference fit, such that to completely assemble into the piston member 43.

The step S106 is to assemble the cap member 41, the resilient member 42, the piston member 43 and the filter member 44 altogether, by having the filter member 44 to contain the piston member 43 and engage with the cap member 41, also with the resilient member 42 retained between the cap member 41 and the piston member 43. Specifically, the step S106 starts from placing the resilient member 42 into the valve cavity 4143 on the pump valve 414 of the cap member 41, then insert the piston member 43 into the valve cavity 4143 on the cap member 41 with the piston head 431 entering first, to retain the resilient member 42 within the valve cavity 4143. The piston head 431 has the outer diameter or the outmost outer diameter substantially equal to the diameter of the valve cavity 4143, such that to slidably engage with the piston head 431 and also to tightly contact, fit the inner wall of valve cavity 4143 for maintaining a fluid tightness therebetween. Furthermore, as the piston member 43 moves, slides related to the pump valve 414 of the cap member 41, the resilient member 42 within the valve cavity 4143 can push back the piston head 431 and return the piston member 43 to the normal state. Thereafter to mount the tubular filter member 44 on the rod portion 435, with the second-anchor structure 441 facing the first-anchor structure 4144 of the pump valve 414, then to move the filter member 44 along the rod portion 435 to contain the piston seat 434 and the piston head 431 and then to engage the second-anchor structure 441 with the first-anchor structure 4144. thereby, the filter member 44 holds and interconnects the cap member 41, the resilient member 42 and the piston member 43 altogether.

The step S107 is to press the assembled the cap member 41 and the resilient member 42 and the piston member 43 and the filter member 44 into the mounting slot 13 of the main body 10, which includes a process of having the rod portion 435 of the piston member 43 to straightly enter the mounting slot 13 first and pass through the seal ring 45, the pad 46 and the jacket ring 47, then to be mounted and fastened within the mounting slot 13, in manner of interference fit. Along with that, a portion of the filter member 44 surrounding the rod portion 435, which is also mounted and fastened within the mounting slot 13 in manner of interference fit, such that to tightly contact and fit the inner wall thereof. Moreover, one of the countersinks of the mounting slot 13 holds and positions an outer surface of the pump valve 414, such that to secure the cap member 41 therein and complete the entire assembling process of the oil-scavenge pump 40.

Additionally in one embodiment, during the step S107 of pressing the assembled the cap member 41 and the resilient member 42 and the piston member 43 and the filter member 44 into the mounting slot 13, the pad 46 and the seal ring 45 may be configured to have an original inner diameter smaller than a diameter of the rod portion 435 of the piston member 43. Such that, as the rod portion 435 squeezes through the pad 46 and the seal ring 45, it stretches the pad 46 and the seal ring 45 wider to tightly contact and fit the inner wall of the mounting slot 13 and hence fasten the pad 46 and the seal ring 45 in manner of interference fit, in order to enhance a stability of the oil-scavenge pump 40 and a fluid tightness between the oil-scavenge pump 40 the main body 10.

Furthermore, in one embodiment, after the oil-scavenge pump 40 is mounted into the mounting slot 13, the next is to apply a riveting process to fasten the head portion 410 of the oil-scavenge pump 40 (the cap head 411 of the cap member 41), such that to further secure the oil-scavenge pump 40 within the main body 10.

As described in the abovementioned embodiment, among the four components 41, 42, 43, 44 of the oil-scavenge pump 40, the cap member 41 and the piston member 43 can be pre-assembled, whereas the resilient member 42 and the filter member 44 are both single components formed as one piece therefore needless to pre-assemble. However, the present disclosure is not limited thereto, the resilient member 42 and the filter member 44 may be configured to include multiple parts that require to pre-assemble, in other embodiment.

Also, in this embodiment, the cap member 41, the piston member 43 of the oil-scavenge pump 40 are pre-assembled in advance (step S104 and S105), and then assembled with other components 42, 44 (step S106) before mounting into the main body 10 of the hydraulic device 1. However, the present disclosure is not limited thereto, in other embodiments, the steps S104 ~ S106 of pre-assembling the components 41, 42, 43, 44 are swappable, furthermore the steps S104 ~ S106 may also be proceeded before the step S102 of mounting the jacket ring 47 into the main body 10.

In summary of the abovementioned embodiments, in contrary to the conventional technology, the oil-scavenge pump 40, the hydraulic device 1, and the method for assembling the oil-scavenge pump 40 according to the present disclosure, which have the following technical advantages.

For the conventional technology, the components of the hydraulic device are fastened and sealed off by welding, however the quality of welding is unstable and hence to also cause unstable fluid tightness of the hydraulic device, moreover, the connection by welding is vulnerable to high temperature and vibration, which can cause safety problems in an operation of the hydraulic device.

In the other hand, the hydraulic device according to the present disclosure, which has a relatively simplified structure and assembling manner, thus a riveting process is applicable to achieve a fine quality of fluid tightness, and therefore no need of welding, which also can secure the components from damage or even breaking apart by rapid vibration or high temperature generated during the operation of the hydraulic device. Also, the method according to the present disclosure, which separates the oil-scavenge pump into four components in advance, such that to reduce the processes for mounting the oil-scavenge pump into the main body, and thereby to facilitate an efficiency of the assembling process.

The above disclosure is only the preferred embodiment of the present disclosure, and not used for limiting the scope of the present disclosure. All equivalent variations and modifications on the basis of shapes, structures, features and spirits described in claims of the present disclosure should be included in the claims of the present disclosure.

We claim:

1. An oil-scavenge pump, comprising:

a main body having a mounting slot;

a jacket ring, pressed and mounted into the mounting slot;

a pad and a seal ring, sequentially placed into the mounting slot;

a cap member comprising a cap head;

a pump valve that is connected to the cap head;

a first-resilient unit that is disposed between the cap head and the pump valve; and a first sphere that is disposed between the first-resilient unit and the pump valve;

a piston member comprising a piston head;

a piston seat that is connected to the piston head;

a second-resilient unit that is disposed between the piston head and the piston seat;

a second sphere that is disposed between the second-resilient unit and the piston seat; and a rod portion that is connected to the piston seat; wherein the seal ring is configured to be mounted to surround the rod portion, the pad is mounted to surround the rod portion; the jacket ring is mounted to surround the rod portion, the seal ring is positioned between the filter member and the pad, and the pad is positioned between the seal ring and the jacket ring;

a resilient member disposed between the cap member and the piston member; and a filter member mounted to surround the rod portion of the piston member and engaged with the pump valve and the cap member, with the resilient member is configured to be retained between the cap member and the piston member;

wherein the piston member, the resilient member, the filter member, and the cap member are assembled together and then pressed and mounted into the mounting slot, with the rod portion of the piston member passing through the seal ring, the pad and the jacket ring.

2. The oil-scavenge pump according to claim 1, wherein the resilient member and the first-resilient unit and the second-resilient unit are springs, the first sphere and the second sphere are steel balls, the filter member is a filter net, the seal ring is an X-ring, and the jacket ring is made of brass.

3. The oil-scavenge pump according to claim 1, wherein the piston head has an outer diameter corresponding to an inner diameter of the pump valve, such that the piston head is slidable relative to the pump valve.

4. The oil-scavenge pump according to claim 1, wherein:

the piston seat has a first end and a second end respectively connected to the piston head and the rod portion;

the first end has an outer diameter smaller than the outer diameter of the piston head; and the second end has an inner diameter corresponding to an outer diameter of the rod portion, such that an inner wall of the second end tightly contacts and fits an outer wall of the rod portion.

5. The oil-scavenge pump according to claim 1, further comprising an oil inlet disposed on the piston seat of the piston member, and an oil outlet disposed on the pump valve of the cap member.

6. A method for assembling an oil-scavenge pump, comprising:

a step of pressing and mounting a jacket ring into a mounting slot of a main body;

a step of placing the pad and the seal ring into the mounting slot sequentially;

a step of pre-assembling a cap member comprising a cap head, a pump valve that is connected to the cap head, a first-resilient unit that is disposed between the cap head and the pump valve, and a first sphere that is disposed between the first-resilient unit and the pump valve;

a step of pre-assembling a piston member comprising a piston head, a piston seat that is connected to the piston head, a second-resilient unit that is disposed between the piston head and the piston seat, a second sphere that is disposed between the second-resilient unit and the piston seat; and a rod portion that is connected to the piston seat;

a step of assembling the cap member, the resilient member and the piston member together sequentially and then mounting the filter member to interconnect the cap member and the piston member, with the resilient member retained between the cap member and the piston member; and a step of pressing and mounting the cap member, the resilient member, the piston member, and the filter member assembled together into the mounting slot, with the rod portion of the piston member passing through the seal ring, the pad and the jacket ring.

7. The method according to claim 6, further comprising a step of fastening the oil-scavenge pump within the mounting slot of the hydraulic device.

8. The method according to claim 6, wherein the step of pressing and mounting the cap member and the resilient member and the piston member and the filter member assembled together into the mounting slot, which further comprises a process of stretching and fastening the pad and the seal ring within the mounting slot in a manner of interference fit.

9. The method according to claim 6, wherein the resilient member and the first-resilient unit and the second-resilient unit are springs, the first sphere and the second sphere are steel balls, the filter member is a filter net, the seal ring is an X-ring, the jacket ring is made of brass.

* * * * *